United States Patent [19]

Sasahara

[11] Patent Number: 4,936,711

[45] Date of Patent: Jun. 26, 1990

[54] PROCESS FOR PREPARING VEGETATION BEDROCK AND MUDDY BORROW SOIL BASE MATERIAL BLASTING NOZZLE USED THEREFOR

[75] Inventor: Joroku Sasahara, Tokyo, Japan

[73] Assignee: Kabushiki Kaisha KumaGAIGUMI, Fukui, Japan

[21] Appl. No.: 305,457

[22] Filed: Feb. 1, 1989

[30] Foreign Application Priority Data

Feb. 12, 1988 [JP] Japan ..... 63-028934

[51] Int. Cl.[5] ..... E02D 3/12

[52] U.S. Cl. ..... 405/263; 405/258; 239/434.5; 239/8

[58] Field of Search ..... 405/258, 269, 266, 263; 239/434.5, 427, 8, 9

[56] References Cited

U.S. PATENT DOCUMENTS

| | | | |
|---|---|---|---|
| 2,318,339 | 5/1943 | Stone | 405/269 X |
| 3,774,683 | 11/1973 | Smith et al. | 405/266 X |
| 4,133,928 | 1/1979 | Riley et al. | 52/309.17 X |
| 4,225,086 | 9/1980 | Sandell | 239/434.5 X |
| 4,264,542 | 4/1981 | Magnus | 249/11 X |
| 4,555,059 | 11/1985 | Collins | 239/434.5 X |
| 4,592,507 | 6/1986 | Benedict | 239/434.5 X |
| 4,662,946 | 5/1987 | Mercer | 405/258 X |
| 4,679,733 | 7/1987 | Lipp | 239/434.5 X |
| 4,768,710 | 9/1988 | Sperber | 239/8 |
| 4,790,691 | 12/1988 | Freed | 405/258 X |

FOREIGN PATENT DOCUMENTS 167170 12/1980 Japan .

*Primary Examiner*—Dennis L. Taylor
*Assistant Examiner*—J. Russell McBee
*Attorney, Agent, or Firm*—Arthur T. Fattibene

[57] ABSTRACT

A muddy borrow soil base material blasting nozzle which has a muddy borrow soil base material injection port having one end of throttled shape, a cylinder integrally provided at the end of the muddy borrow soil base material injection port, and an air intake port formed near the end of the injection port at the side face of the cylinder, the air intake port being used as an intake port of one or more threadlike, ropelike or tapelike continuous elements into the cylinder, and a process for preparing a vegetation bedrock using the muddy borrow soil base material blasting nozzle having the steps of press-fitting a muddy borrow soil base material into the blasting nozzle, blowing the threadlike, ropelike or tapelike continuous elements introduced by intaking from the air intake port of the blasting nozzle into the cylinder together with the muddy borrow soil base material from the discharging port of the nozzle toward the surface to be executed to prepare a plant germinating and growing bedrock. Thus, the nozzle can obtain stably reinforced surface to be executed with large possible blasting amount per one blasting, large discharging distance, good water retention properties, temperature maintaining property, drainage and air permeability by a method of employing a mixture blasting unit of muddy material and fibers.

15 Claims, 9 Drawing Sheets

PROCESS FOR PREPARING VEGETATION BEDROCK AND MUDDY BORROW SOIL BASE MATERIAL BLASTING NOZZLE USED THEREFOR

BACKGROUND OF THE INVENTION

The present invention relates to a process for preparing a vegetation bedrock on the surface of soil to be executed in civil engineering works and a muddy borrow soil base material blasting nozzle used for the same process.

More specifically, the invention relates to a process for preparing a vegetation bedrock of a thick layer capable of growing plants when the soil of an oblique surface to be vegetated (hereinafter referred to as "a normal surface"), such as the oblique surface of broken soil, a cut or an embankment generated by a development construction has wrong plant growing conditions, such as a bedrock, a soft rock containing less soil, sand soil or heavy clay soil, and growing plants in the bedrock for its vegetation as well as a muddy borrow soil base material blasting nozzle used for the same process and, more particularly, to a process for blasting mixture of muddy borrow soil base material with continuous elements, such as threads or tapes to the surface to be blasted, such as the normal surface and the blasting nozzle. The process according to the present invention can be utilized for growing plants on not only the normal surface but a sand hill which is remarkably dried.

DESCRIPTION OF THE PRIOR ART

Heretofore, there has been known a process for blasting the mixture of muddy soil to become the borrow or top soil for vegetation on bedrock or barren soil with a hydrophobic agent and air from the discharging port at the end of a blasting nozzle by forcibly mixing and agitating the mixture in the nozzle. According to this process, the muddy soil is blasted while being agglomerated into a mixture of the muddy soil with the hydrophobic agent and the air in the nozzle, and the mixture adhered to a normal surface considerably in a thick state to be stabilized.

This process is generally executed frequently on an abruptly oblique surface. In large-scale work, such as the construction of an express highway executed between mountains in the country, long and large normal surfaces are accordingly generated at many places. Such long and large normal surfaces comprise bedrocks or soil on which it is most difficult to grow plants. A plant growing base material, such as soil of high quality is blasted several centimeters of thickness to such a place to prepare a plant growing topsoil to conduct a process for reviewing nature with vegetation. However, since the surface to be executed is abruptly oblique, the thickness of the plant growing soil which can be adhered is technically and economically limited. According to the process at present, it is expected to prepare a plant growing layer of top soil of approx. 10 centimeters at its maximum thickness or at least several centimeters sufficient to grow plants.

As the recent trend of the process for preparing a vegetation top soil, the type of the plants to be introduced to the plant growing process becomes a problem to permanently maintain the vegetation. In case of herbaceous plants to be easily introduced, hair roots become main bodies, and since the roots are not extended deeply in mountain soil, manure is lost in several years, they are degenerated by drying, and might be broken together with the surface layer of the normal surface. Thus, it is desired to initially introduce large plants which have taproots of main bodies so as to early expect a forestation.

There has been disclosed, as a related prior art not directly, a process for preparing a vegetation top soil in Japanese Patent Laid-open No. 167170/1980. This patent proposes a process for reinforcing road side faces or a pavement by carrying slender fiber of polyester on high pressure water to be continuously fed from a nozzle, and mixing it with sand blasted by compressed air from another nozzle onto the surface to be executed. There was also known a process for fixing mortar blasted from a mortar gun with glass fiber in a laminar state by blasting the mortar from the gun to strengthen the surface of a base and continuously feeding the glass fiber from another fiber dispenser to integrate both on the surface to be executed.

The conventional process executed in accordance with the prior invention of Japanese Patent Laid-open No. 156170/1980 will be described with reference to FIG. 13. In FIG. 13, in order to execute the upper surface of a base course 40, sand S collected from a sand hill 50 is fed under pressure by compressed air A by a compressor 51 through a conduit 49, and blasted to the surface to be executed of the base course 40 from a nozzle 43. On the other hand, threads (fiber) T fed from a thread feeder 54 are integrated with water W of high pressure through a high pressure pump 53 from a water tank 52 by an ejector 44, extruded by the high pressure water W, and blasted together with the high pressure water W to the surface to be executed of the base course 40 from the nozzle 45 of the ejector. The threads T (4 in FIG. 13) are extruded one by one through fine holes of the nozzle 45 by the high pressure water W at this time, mixed with the sand S on the surface to be executed in a three-dimensional manner to form a rigid base course. Thus, in this process, the fiber of the threads T and the soil particles of the sand S are separately supplied to the surface to be executed by two separate systems to integrate both the fiber and the soil particles in mixture on the surface to be executed.

In the prior art, it is necessary to employ the blasting muddy materials again after the layer blasted previously was drained and stabilized so as to obtain the vegetation foundation of a thick layer. Thus the prior process has a timing loss to have the drainage of the vegetation foundation as a large disadvantage to raise the efficiency.

The normal surfaces to be executed for receiving a vegetation top soil mostly have in general steep gradients of 45 to 65 degrees, and the adhering thickness of the vegetation top soil is at most 3 to 8 cm. According to the prior art process, the thickness of the top soil to be adhered by blasting is approx. 3 cm even in the case where the soil and rock of the normal surface have good water absorption properties, and becomes approx. 1 cm on the normal surface having improper or poor water absorption properties, such as clay or one rock. In summary, the agglomeration of the muddy soil of the feature of the prior art is performed, and the soil momentarily becomes hydrophobic, but since the drainage from the interior of the top soil is gradually executed, if a large quantity of muddy soil is blasted continuously, the weight of the water is added so that the soil slides down, and the blasting amount per one blasting step must be limited.

Further, in the prior, vegetable fiber is mixed as so-called tie material in the muddy soil to stabilize the blasted top soil. The length of the fiber is short, e.g. 2 to 3 cm, and the effect is scarcely obtained. The longer the tie material, the greater the effect becomes, but when the tie material is mixed in advance in the muddy borrow soil base material, it causes a pump to be blocked due to winding on the material agitating shaft, causing entanglement of the pressure feeding pump shaft, and clogging between an impeller and a casing, this length of the fiber that can be mixed is thus limited.

In the prior art process as described above, only approx. 5 cm of borrow soil or plant growing base material is adhered to the normal surface of a bedrock having poor plant growing conditions. In such a case, even if the plant growing base material, such as borrow soil, is adhered, it is completely dried in a short time under the blazing sun in summer, and seedlings of the plants slightly grown are frequently seasoned to die due to lack of water content.

From the above-mentioned circumstances, there is employed at present the use of viscous soil having high water retention characteristics or a method of preventing drying by mixing a plant growing base material with a water retension material, such as vermiculite or high water absorption resin, but even if any water retention material or viscous soil is used approx. 5 cm of thickness, a considerable effect cannot be obtained at present.

It is desired to initially introduce large plants to permanently vegetate a bedrock and to early forest it, but the large plants are affected in the germination according to not only the dry or wet bedrock but the difference of cold or warm (chilled) temperature after the seeds are planted. In order to sufficiently provide the growing period after the seeds are planted, the introduction of the large plants cannot be expected unless the execution is conducted in spring. Thus, it is necessary to devise the planting of the seeds in spring by extending the execution (planting of seeds) of the large plants by alleviating the temperature rise or fall in the plant growing bedrock due to the difference of cold or warm atmospheres and preventing moisture from evaporating from the ground and mountains.

In Japanese Patent Laid-open No. 167170/1980 as related prior art, the object is to reinforce the work by mixing fiber in the surface to be executed of road or normal surface to solidify the surface. Accordingly, this is different from the object of the present invention of accelerating the vegetation by forming suitable air gap necessary to germinate and grow plants by agglomerating muddy borrow soil base material necessary for its vegetation and mixing continuous elements, such as threads or tapes in the surfaces to be executed to impart water retention properties, drainage, air permeability, temperature maintaining property in the vegetation bedrock.

However, the method of mixing with bedrock material by blasting continuous elements of fiber as a reinforcing material to the surface to be executed is similar to the present invention. But, the different points of this method from the present invention resides in that the material of the bedrock is sand or mortar, different from the vegetation bedrock of the present invention, and the mechanism of the nozzle or gun for blasting the fiber as the reinforcing material is fundamentally different. In other words, according to the prior method as described above, the feeding mechanisms for the reinforcing materials, such as the top soil material and the fiber are separately operated to be blasted, and both are integrated in mixture on the surface to be executed. Thus, the bondability of both after the bedrock material and the reinforcing material are mixed is wrong. Accordingly, sufficient effect for stably reinforcing the surface to be executed cannot be expected.

According to the prior methods, the fiber having substantially the same size as that of an injection port is extruded from the injection port by utilizing the injecting pressure of clean water, for example, by a high pressure pump for blasting the fiber to fly it to the surface to be executed. The thickness of the threads is thin approx. 200 microns, and since the diameter of the injection port of the nozzle is small, the nozzle tends to be easily blocked. Even if the fiber is injected under high pressure, the flying distance of the fiber becomes short, such as 2 to 3 cm in fact, which is not proper for a covering work of a long and large normal surface.

SUMMARY OF THE INVENTION

Accordingly, an object of the present invention is to provide a process for preparing vegetation top soil with reinforcing fiber and a muddy borrow soil base material blasting nozzle used for applying the same in a manner to eliminate the aforementioned problems in the prior art and can solve technical subjects to obtain stably reinforced surface to be executed with large amount of material per one blasting, with associated large discharging distance, good water retention properties, temperature maintaining property, drainage and air permeability.

Atmospheric air is taken into a cylinder by a pressure reducing effect generated in the cylinder by the injection of vegetation top soil material being muddy from an injection port of the blasting nozzle, and threadlike, ropelike or tapelike continuous elements inserted externally into the air intake port to be introduced together with the air into the cylinder of the blasting nozzle. The muddy vegetation material is mixed with the continuous elements in the cylinder, and discharged out to the exterior from the discharging port at the end of the blasting nozzle to pull the continuous elements so that, both are adhered to the surface to be executed in the state that top soil and fiber are entangled with each other. In this case, the blasting nozzle is fluctuated in a predetermined width upward and downward, and rightward and leftward so that the continuous elements are buried in the vegetation top soil in a network state to stabilize the surface to be executed, thereby improving the water retention properties, drainage and air permeability in the bedrock.

When a hydrophobic agent is poured in the cylinder of the blasting nozzle, the hydrophobic agent, the muddy material and the air are mixed and agitated in the cylinder to separate the water from the muddy material by the operation of the hydrophobic agent to agglomerate the muddy material. Thus, the agglomerated vegetation top soil material is discharged out from the nozzle discharging port to pull the continuous elements and adhered the same to the surface to be executed. At this time, since the vegetation top soil material is agglomerated, the top soil material is preferably entangled with the continuous elements to further improve the water retention properties, drainage, air permeability and temperature maintaining property of the surface to be executed after blasting, thereby stabilizing the top soil.

Further, the discharging distance of the material from the nozzle is lengthened.

A tape mulching method for covering the surface of a plant growing may be prepared with water impermeable tapelike continuous elements by blowing the continuous elements to the surface of the, as will be described. In this case, the same effects as those of a film mulching method for preventing moisture dew-condensed on the lower surface of a film due to atmospheric temperature rise and fall or moisture evaporated from a land to prevent it from drying by covering a farm on which seedlings are planted or a land on which seeds are planted with straws or a plastic film, or in a dry land, such as a desert, by covering a plant growing surface entirely with a film. In this case, the tape is used to cover an abruptly oblique surface or a normal vigorously uneven surface with a thin film of a tape without irregularity in response to the uneven surface.

Then, when continuous elements made of water impermeable tape adhered with aluminum foil, or aluminum powder and having heat beam reflecting elements are covered on the front surface by blowing them to the surface of a plant growing bedrock, even if cold and warm atmospheric temperature difference exists by the covering, the temperature rise and fall in the plant growing bedrock due to the heat beam reflection are alleviated, and the evaporation of moisture from mountain soil is prevented to extend the period capable of planting plant seeds.

Other and further objects, features and advantages of the invention will appear more fully from the following description.

BRIEF DESCRIPTION OF THE DRAWINGS

FIG. 6(*e*) shows an irregular fiber bundle;

FIGS. 11 and 12 show underground temperature characteristic diagrams of the tape mulching method execution zones with water impermeable tape having heat beam reflecting elements, wherein FIG. 11 shows temperature change after execution in winter, and FIG. 12 shows temperature change after execution in summer.

DETAILED DESCRIPTION OF THE PREFERRED EMBODIMENTS

Embodiments of the present invention will be described in detail with reference to the accompanying drawings.

Figure 1A:
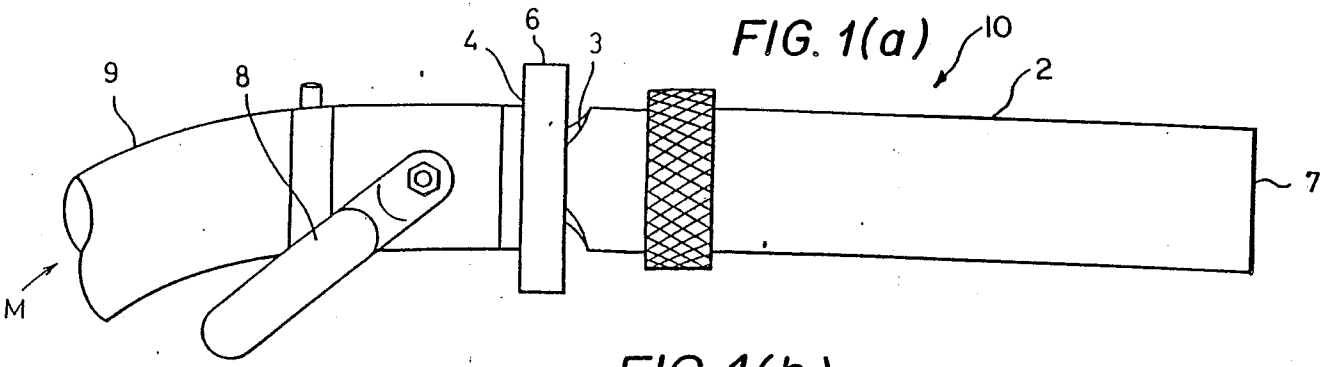
FIGS. 1(*a*) show a side elevation of an embodiment of a muddy material blasting nozzle according to the present invention, and FIG. 1(*b*) is a sectional view of the essential portion.
Figure 1B:
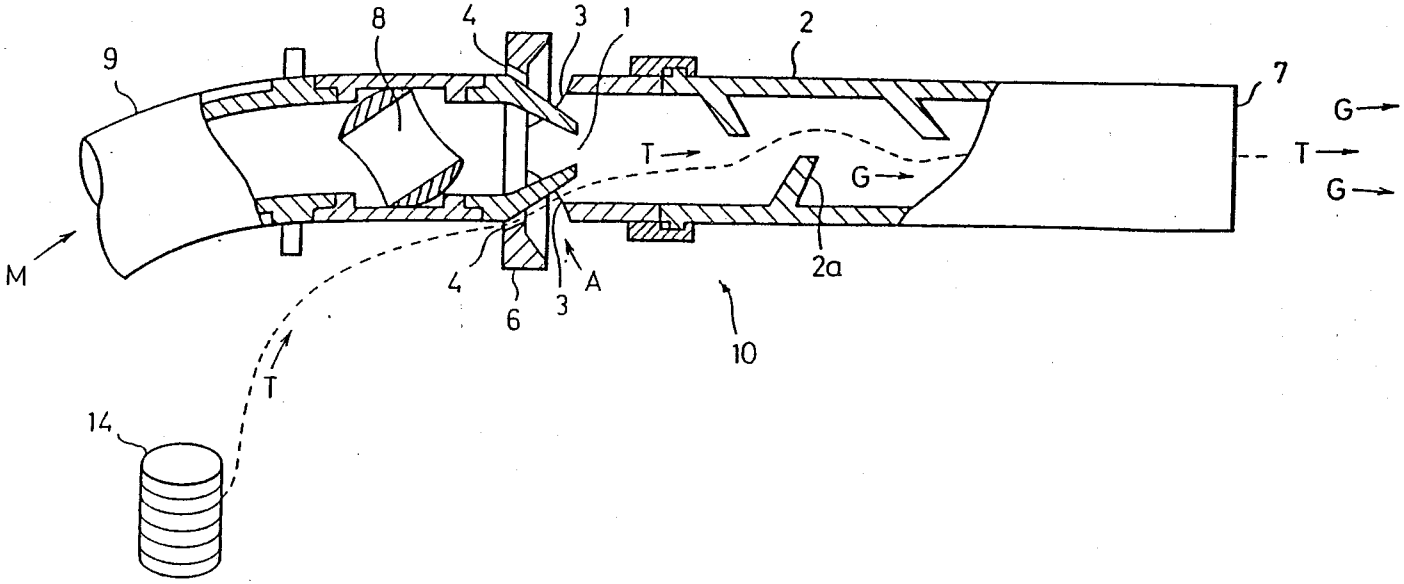

FIG. 1(*a*) shows a side elevation vegetation bedrock material blasting nozzle 10 according to the present invention, and FIG. 1(*b*) is a sectional view of the essential portion of the nozzle.

In FIGS. 1(*a*) and 1(*b*), reference numeral 1 denotes an injection port of muddy borrow soil base material M, and numeral 2 denotes a cylinder attached to the end of injection port 1 and having therein a plurality of agitating blades 2*a*. The cylinder (hereinafter referred to as "an agitating cylinder") 2 may be of the type having no agitating blades 2*a*. Numeral 3 denote air intake ports, and numeral 4 denote insertion guide holes of continuous elements T of fiber, such as threads, which holes are connected through the air intake ports 3 to the agitating cylinder 2. When the number of the holes 4 is increased in a circumferential direction, two or more threads T can be simultaneously fed into the agitating cylinder 2 to densify the mixture of the threads T into a vegetation material G. Numeral 6 denotes muddy soil scatter preventing cover, numeral 7 denotes the discharge port of the nozzle 10, and numeral 8 denotes a muddy borrow soil base material regulating cock of ball valve type. Numeral 9 denotes a rubber hose which is connected to a muddy borrow soil base material feed pump, not shown. Numeral 14 denotes a winding of the continuous element T.

Figure 13:
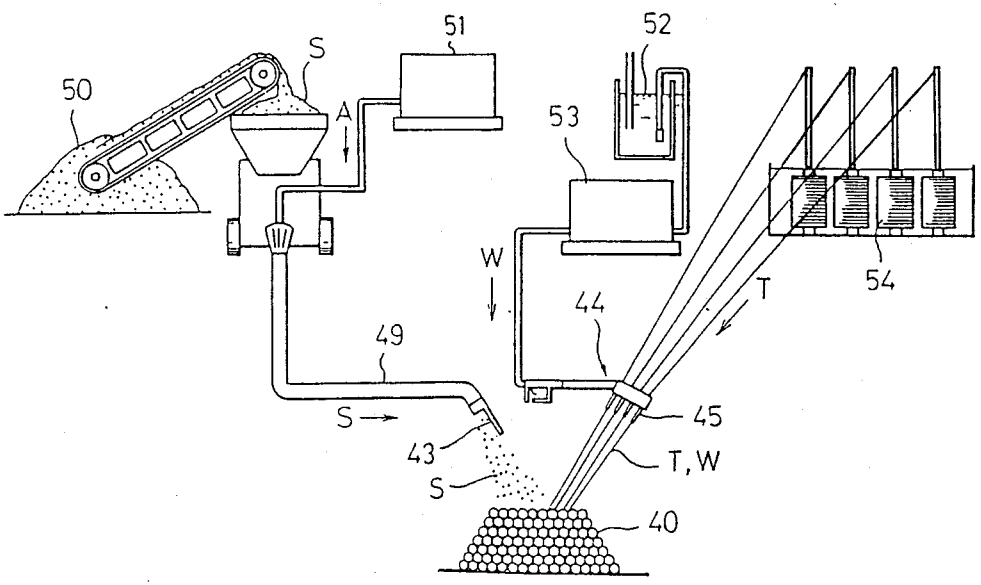
FIG. 13 shows a base course execution process mixed with sand and continuous elements according to the prior art.

A vegetation soil material is applied to a surface to be executed, such as a normal surface by using the muddy material blasting nozzle of the construction described above. The operation of the nozzle will be described. The muddy borrow soil base material M fed under pressure by a muddy material feed pump, not shown, is fed through the rubber hose 9 to the blasting nozzle 10, the feeding amount being regulated by the muddy borrow soil base material regulating cock 8. The base material M then arrives at the injection port 1, from which the muddy material M is injected into the agitating cylinder 2. Negative pressure is generated at the inlet of the agitating cylinder 2 by the injection, thereby intaking air A through air intake ports 3 into the cylinder. The continuous elements T, such as the threads are fed by the intake force of the air from the winding 14 through the insertion guide ports 4 adjacent to the air intake ports 3 and into the agitating cylinder 2. The muddy material M, the air A and the continuous elements T are integrated in a mixture in the cylinder 2, and preferably agitated by contact with the agitating blades 2*a* to form the vegetation material G, which is discharged from the discharging port 7 toward the surface to be executed. Since the threads and the soil are preferably agitated in mixture in the same nozzle before being discharged, the draping (bondability) of both is improved to form a stable base course. The size of the insertion guide hole 4 for the threads or the like is much larger than that of the hole through which the thread is passed in the prior art (see FIG. 13). Accordingly, the guide hole is not blocked during the usage. The size of the discharging port of the blasting nozzle is also large. Hence, the discharging pressure is large, and the flying distance of the vegetation material G to the surface to be executed at the time of blasting is therefore longer than that in the prior art preferable for preparing a long and large normal surface.

A modified embodiment of the present invention will be described with reference to the accompanying drawings.

Figure 2:
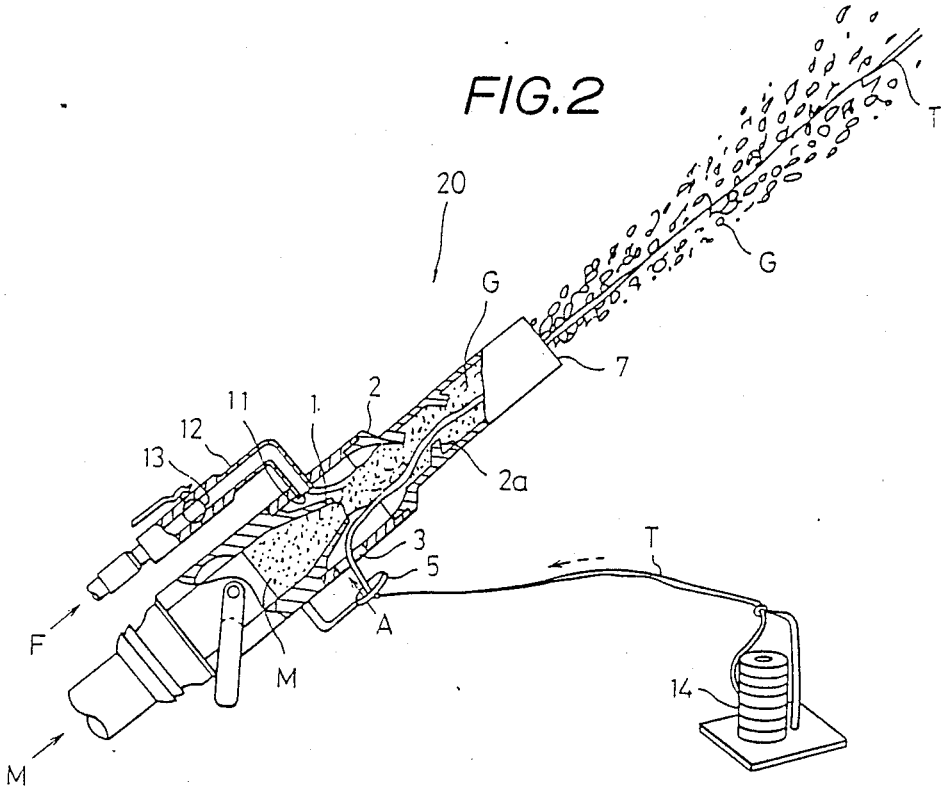
FIG. 2 is an explanatory view of another embodiment of a muddy material blasting nozzle according to the present invention, illustrating the state of executing the blasting work of the nozzle.

FIG. 2 is an explanatory view showing an essential portion when a blasting work is executed by injecting a vegetation soil material and continuous elements from a vegetation blasting nozzle 20. A difference between the blasting nozzle 20 in FIG. 2 from the blasting nozzle 10 in FIG. 1 is that the nozzle 20 has a hydrophobic agent pouring port 11, the other parts of the nozzle 20 being fundamentally the same as those of the nozzle 10, wherein the same common components of the nozzle 20 as those in the nozzle 10 are designated by the same reference numerals.

In the construction of the vegetation material blasting nozzle 20, an agitating cylinder 2 is attached to the end of a muddy material injection port, having a shape that is throttled, and the hydrophobic agent pouring port 11, the air intake port 3 and the end discharging port 7 are formed as part of the agitating cylinder 2. Agitating blades 2*a* are provided in the agitating cylinder 2. On the other hand, a threadlike, ropelike or tapelike continuous element T is contained on a winding 14, and the continuous element T is fed through a thread insertion guide ring 5 and the air intake port 3 and out of the blasting nozzle 20 from the end discharging port 7 of the nozzle 20.

In the construction described above, muddy borrow soil base material M is fed under pressure by a pump (not shown) as designated by an arrow into the injection port 1, from which the muddy material M is injected by strong pressure into the agitating cylinder 2. Air A is sucked through the intake port 3 into the agitating cylinder 2 by means of the pressure reducing effect in the agitating cylinder 2 caused by the injection. In this case, the continuous element T is fed from the winding 14 through the air intake port 3 (in the direction of an arrow with a broken line), and mixed with the vegetation material G, and both are simultaneously discharged externally from the end discharging port 7 of the blasting nozzle 20.

The continuous element T is easily introduced into the agitating cylinder 2 by the force of the air A thus intaken. The element is not limited to only one. Two or more air intake ports 3 may be formed to separately introduce two or more continuous elements T, or two or more continuous elements T may be introduced from one air intake port 3.

Hydrophobic agent F is fed under pressure by a pump (not shown) through a pipe 12 to be introduced through hydrophobic agent pouring port 11 into the agitating cylinder 2 where the muddy material M, the hydrophobic agent F and air A are mixed in the agitating cylinder 2. The muddy borrow soil base material M is agglomerated here to become a vegetation soil material G.

The muddy borrow soil base material M in the present invention is used as the soil base material, and manure, seeds, and/or root stems may be suitably mixed therewith, together with vegetable fiber, and/or erosion preventing agent are mixed as required, and suitable quantity of water is mixed to prepare as a muddy material.

The hydrophobic agent includes, for example, polyacrylamide hydrolyzate or the like, which has an effect of separating water by causing the muddy borrow soil base material M to agglomerate it.

The continuous element T of the maximum feature of the present invention is of threadlike, ropelike or tapelike continuous, slender article, and its shape is not limited. If the weight is excessively heavy, it is not preferably mixed with the muddy borrow soil base material M, i.e., the vegetation bedrock material G to be scattered while being agglomerated by the blasting nozzle but dropped on the way, thus a relatively light continuous element T is accordingly preferable.

Figure 3:
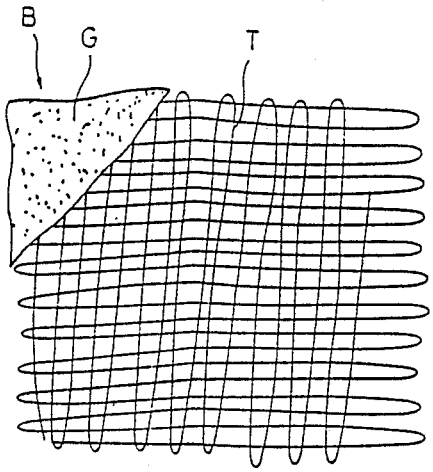
FIG. 3 is an exploded front view of the essential portion in the normal surface to be blasted according to the invention.
Figure 4:
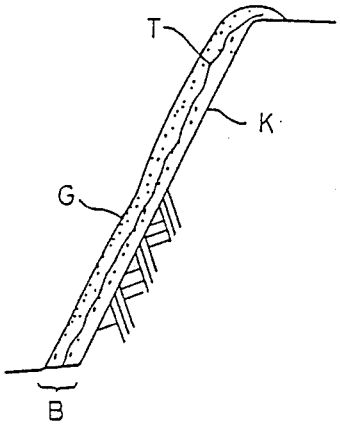
FIG. 4 is a side sectional view of the same normal surface.

In case of the blasting work, the blasting nozzle 20 is fluctuated in a predetermined width upward and downward, rightward and leftward to bury the continuous element T in the vegetation material in mesh state to be stably adhered to the normal surface. Thus, an agglomerated borrow soil layer B is formed as shown in FIGS. 3 and 4 on the normal surface. FIG. 3 is an exploded front view of the essential portion of the agglomerated borrow soil layer B on the normal surface by blasting according to the embodiment, and FIG. 4 is a side sectional view similarly of the agglomerated borrow soil layer B. As shown in FIGS. 3 and 4, the continuous element T is buried elevationally and laterally in a mesh state, and the vegetation material G is adhesively laminated on the lower and upper layers to form the agglomerated borrow soil layer B to be stably prepared on the normal surface K. At this time, the continuous element T can absorb and seal water hydrophobically treated when it is agglomerated in the air gap of the element to retain the water for a long period of time, and the air is fed from the position exposed on the surface of the borrow soil layer B through the air gap of the element into the interior of the borrow soil layer B to operate as ventilation.

Figure 5:
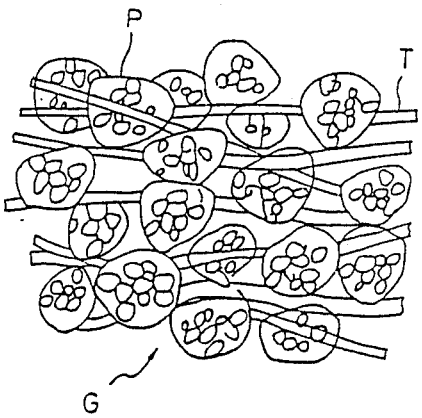
FIG. 5 is an enlarged view of the mixed state of agglomerated soil particles and continuous elements.
Figure 6A:
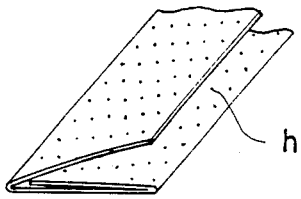
FIGS. 6 shows the examples of the shapes of various types of continuous elements, wherein FIG. 6(*a*) shows three-folded tape, FIG. 6(*b*) shows two-molded tape, FIG. 6(*c*) shows a tubular shape, FIG. 6(*d*) shows a fiber bundle.
Figure 6B:
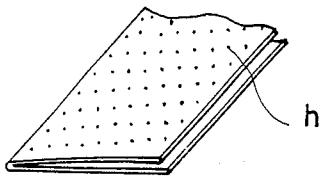
Figure 6C:
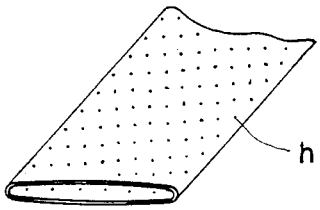
Figure 6D:
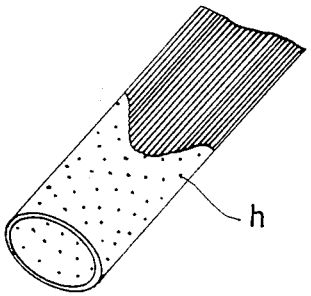
Figure 6E:
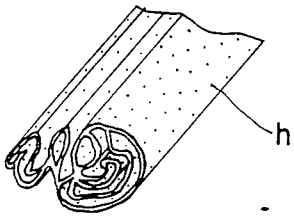

FIG. 5 shows a partially enlarged view of the state that the continuous element T is mixed in the vegetation material G. As shown in FIG. 5, the agglomerated vegetation material G becomes an agglomeration of individual soil particles P, and mixed with the continuous element T entangled among the soil particles P. Thus, the soil particles and the continuous element are supported to each other, and gaps for retaining the water and ventilating air are maintained thereamong.

As described above, the continuous element T mixed in a three-dimensional manner in the vegetation material G thus blasted supports the vegetation material G to be slid down by the mutual entanglements. Accordingly, the blasting thickness can be increased to 10 cm or larger by one blasting work to very efficiently prepare the stable vegetation soil material, thereby largely improving the efficiency irrespective of the the inclination of the normal surface, the soil and the rock.

The fluctuation of the blasting nozzle 20 may not always be conducted upward and downward, rightward and leftward according to the state of the normal surface. For example, if the normal surface is much uneven, the blasting nozzle 20 is fluctuated only rightward and leftward to move the continuous element rightward and leftward, thereby performing the object.

When the continuous element T which is treated with antiskid or formed to be easily entangled is employed, it can obtain further excellent antiskid effect.

When the shape and the strength of the continuous element T are differently formed, various operations and effects can be expected. For example, when the continuous element having large tensile strength is employed, it can expect the breakage preventing effect of the normal surface.

In other words, for the purpose of stabilizing the blasted vegetation material and preventing the small breakage of the normal surface at present, a base network (See 23 in FIG. 7) made of rhombic lath metal gauze or synthetic resin network is extended before blasting, and the vegetation bedrock material is blasted thereon. However, when the shape and the strength of the continuous element are devised in the process of the invention and the continuous element is buried in a mesh state in the vegetation material, the extension of the base network in the prior art can be eliminated.

When the tapelike continuous element of two-or more folded state overlapped as shown in FIGS. 6(*a*) to 6(*e*) is employed, the water retension properties and air permeability of the vegetation bedrock interior can be improved. FIGS. 6 show some examples adapted therefor, wherein FIG. 6(*a*) shows three-folded tape state, FIG. 6(*b*) shows two-folded tape state, FIG. 6(*c*) shows a tubular state, FIG. 6(*d*) shows a fiber bundle, and FIG. 6(*e*) shows an irregularly folded fiber bundle, and reference character h shows holes for air or water permeation opened thereat.

More specifically, the normal surface to be executed for vegetation by blasting a plant growing material generally contains bedrock of abrupt oblique and grows plants is limited several cm of thickness of the bedrock. Therefore, the presence of the water retension properties of the bedrock largely affects the growth of plants, and since the surface to be executed is of normal surface formed by cutting the mountain surface, water flowing between the mountains flows out on the normal surface, the place where is always wet is prepared, the bedrock at this place is saturated with the water to become an oxygen-lack state, thereby disturbing the growth of the plants.

In order to grow the plants in the vegetation bedrock of the limited thickness even under such poor wrong conditions, when the tapelike continuous element two or more-folded as described above or the like is buried by the process of the invention, the gaps formed by the foldings perform the operation of enhancing water retension properties, drainage, air permeability, etc., thereby expecting the maintenance of always preferably conditions for the growth of the plants.

A flat yarn (tapelike long article) in which aluminum foils are laminated (bonded) is used as the continuous element T to alleviate the temperature difference in the soil. Thus, the influence of the temperature difference to the atmospheric air to the vegetation material interior can be reduced to decrease the influence at the time of severe cold in winter and hot in the blazing sun in summer. Accordingly, the suitable period of the vegetation work to be forcibly conducted for improper period execution can be extended.

Then, an example of the result of experiments executed according to the invention will be described. In this experiment, the following mixture composition of the muddy borrow soil base material was used.

| | |
|---|---|
| planting soil (including organic manure) | 2500 liters |
| vegetable fiber | 960 liters |
| chemical manure | 40 kg. |
| erosion preventing agent | 90 liters |
| (special asphalt emulsifying agent, etc.) | 0.7 kg. |
| seeds (Kentucky 31F, etc.) | |

The mixture was of the quantity per 30 $m^2$ of blasting area when the thickness of blasting was 10 cm.

2000 liters of water was filled in a base material tank (having 4000 liters of volume) of a blasting machine, the mixture material described above was then mixed therewith, and the mixture was agitated to be muddy.

On the other hand, 600 g of hydrophobic agent (polyacrylamide hydrolyzate) was used for the mixture, dissolved in 300 liters of water in a hydrophobic agent tank (having 300 liters of volume) to prepare 0.2% aqueous solution.

As the continuous element, 2000 m of one winding of polyethylene flat yarn having 6 mm of width with 200 g or weight was prepared.

A blasting nozzle 20 as shown in FIG. 2 was used to feed under pressure the muddy borrow soil base material M by a slurry (muddy material) pump to the injection port 1, the hydrophobic agent F was introduced by a gear pump to the hydrophobic agent pouring port 11, the polyethylene flat yarn was inserted at its one end from the air intake port 3 through the guide ring 5 into the agitating cylinder 2, and the winding 14 was freely rotated for the polyethylene flat yard to be fed.

When the blasting was started, air is sucked through the air intake port 3 by the injection pressure of the muddy borrow soil base material M being fed into the blasting nozzle 20, the hydrophobic agent F and the air A are mixed and agitated forcibly by the injection stream of the muddy borrow soil base material M in the agitating cylinder 2, agglomerated, and water added in advance in the base material tank to improve the fluidity in the muddy borrow soil base material M at this time was hydrophobically treated to be plasticized to become vegetation material G, and discharged externally from the discharging port 7.

On the other hand, the polyethylene flat yarn introduced from the air intake port 3 was fed into the agitating cylinder 2 by the intake force of the fed air, flown together with the vegetation base material G from the discharging port 7 under the tension of the discharge of the vegetation material G, and adhered in the state mixed in a three-dimensional manner in the vegetation material G of the surface to be blasted.

In this case, the blasting nozzle 20 was fluctuated widely upward and downward, and rightward and leftward by a manual work as much as possible to regulate the blasting range to the normal surface both upward and downward, and rightward and leftward approx. 10 m.

In this manner, the polyethylene flat yarn flown together with the vegetation material G was adhered in the shape to be buried in a complicated mesh state into the adhered vegetation interior.

In this case, the using amount of the polyethylene flat yarn was approx. 2500 mm for the one tank (having 4000 liters of volume) of the blasting machine of the muddy borrow soil base material M. It was also understood that the using amount was irrespective of the fluctuation method of the blasting nozzle.

In the experiment example, the normal surface to be blasted had 65 degrees gradient, and approx. 10 cm of thickness of a vegetation soil material was prepared by one blasting work, and the vegetation material did not slid down at all.

In the prior art, in the case of the normal surface of such an abrupt oblique surface, when 3 cm or more of thickness was blasted by one blasting work, it would erode or slide down. Accordingly, it was necessary to blast 3 to 4 times by waiting the drainage at each time, but in comparison, the process of the present invention can perform the preparation of the vegetation bedrock extremely efficiently.

In this experiment, only one polyethylene flat yarn was used. However, it was confirmed by another experiment that two or more polyethylene flat yarns could be simultaneously used by providing two or more air intake ports at the blasting nozzle.

According to the present invention, since the muddy material injected from the injection port 7 was injected in mixture with the continuous element T of fiber inserted from the air intake port 3 in the cylinder, the continuous element T became very preferably draped with the gravel after it was blasted to the normal surface. In order to measure the draping effect with the gravel, the following measurement was conducted. More specifically, nonflammable multifilament of polyester was used for the long fiber of the continuous element T, the yarn was slowly pulled out from the adhered surface, after blasting, and the gravel adherence amount was measured. As a result, as in the prior art, when the yarn (fiber) and the gravel were separately blasted from separate nozzles, the gravels were not adhered to most yarns, but according to the present invention, after the yarn and the gravel was mixed in the nozzle cylinder and then blasted, the yarn was entangled with the gravel to adhere a large quantity of the gravel thereto. The measurement result is shown in Table 1.

TABLE 1

| Blasting method | Measured Weight | | |
|---|---|---|---|
| | Weight of yarn adhered with gravel (1) | Weight of yarn washed off gravel (2) | Weight of gravel adhered (3) = (1) − (2) |
| Separate nozzles (Prior art) | 0.12 g | 0.09 g | 0.03 g |
| One nozzle with gravel (The present invention) | 15.8 g | 0.09 g | 15.71 g |

However, the length of the measured yarn was 1 m×5, (1) the weight of the yard adhered with the gravel while removed from the blasted surface, and (2) the weight of the yarn of the bare state that the gravel was washed off the yarn, were measured, and (3) the weight of the gravel adhered to the yard=(1)−(2) was measured for the degree that the gravel was adhered to the yarn, i.e., the draping effect of the yarn with the gravel. As a result, as listed in Table 1, the process for blasting the gravel (borrow soil base material) from one nozzle together with the thread to the surface to be executed could adhere more gravel to the thread, and it was understood that the draping effect of the thread with the gravel was larger. It was understood that the tension of the thread sufficiently perform the effect to the pressure and the tensile force applied to the gravel on the surface to be executed, could hold the strength of the bedrock as compared with the prior method and performs to hold the stability.

Since the muddy material blasting nozzle of the present invention feeds under pressure by a slurry (muddy material) pump having large feeding liquid amount to inject from a hole having large size of 20 mm of the diameter of the injection port, the flying distance of the muddy soil becomes approx. 20 m, and the long fiber of the continuous element mixed therewith is followed to the position where the muddy soil is scattered. When the quantity of the water mixed with the gravel is increased and the muddy material of low concentration was prepared and blasted to raise the feeding liquid head (pressure) of the slurry pump for feeding the liquid, the injection pressure from the nozzle was raised, but the flying distance was, contrary thereto, reduced by the scattering by the resistance of the air after injected from the nozzle.

Therefore, in the invention, a device for mixing hydrophobic agent (agglomerating agent) F (hydrophobic agent pouring port) is provided in the cylinder 2 attached to the end of the muddy material injection port 1, the muddy material M and the hydrophobic agent F are mixed while the air is intaken from the air intake port 3 by the injection pressure of the muddy material, the muddy material M is agglomerated with the air A as a catalyst to separate the water used for forming the muddy material to agglomerate the muddy material M, thereby successfully preventing the muddy material injected from the nozzle from scattering.

The gravel plasticized and agglomerated in separation from the water is flown 30 to 40 m without scattering, the continuous long fiber mixed at the time of agglomerating with the muddy material M is completely mixed closely with the gravel, flown to completely follow the gravel flown 30 to 40 m, and stably adhered in the state mixed in a three-dimensional manner in the gravel.

Then, the flying distances of the threads according to the methods in comparison with the measurement are listed in Table 2.

TABLE 2

| | Prior art | This invention | |
|---|---|---|---|
| | Method | Method (1) | Method (2) |
| Flying distance of thread | 2–3 m | 15–20 m | 30 = 40 m |

In Table 2, the prior art method injected 1 liter of water from a hole having 1 mm of diameter, and flied the yarn by utilizing the injection pressure.

In the method (1) of the invention, 2000 liters of water was mixed with 2500 liters of muddy soil to prepare the muddy material, and the muddy material was blasted together with long continuous fiber without agglomerating the muddy material by using the high pressure slurry pump having 17 kg/cm$^2$ of head.

In the method (2) of the invention, 600 liters of 2%-polyacrylamide aqueous solution was mixed as a hydrophobic agent in the nozzle, and the continuous long fiber was blown while the muddy material was agglomerated with the air as a catalyst.

As listed in Table 2, according to the present invention, the flying distance of the thread by the prior method can be extended by ten times as long, and the work on the surface to be executed such as long and large normal surface can be efficiently performed.

The interior of the cylinder 2 of the nozzle is reduced under pressure by the injection from the muddy material injection port 7, the size of the air intake port 3 for intaking the continuous long fiber T together with the air A by the pressure reducing effect is opened in size of 5 to 6 times as large as the 2 cm of the diameter of the muddy injection port 1, and the blocking of the injection port with a foreign material due to the small size of the injection port of the continuous long fiber is eliminated. Further, arbitrary number of fibers having different diameters can be easily flown by one nozzle.

In one embodiment (FIG. 2) when the hydrophobic agent valve 13 of the blasting nozzle 20 is blocked to stop pouring of the hydrophobic agent F from the hydrophobic agent pouring port 11 into the agitating cylinder, its operation becomes entirely the same as that of FIG. 1 using the blasting nozzle 10 and similar effects to the same are, of course, obtained.

Embodiments of the present invention are executed to provide the effects of retaining water and draining in the plant growing bedrock prepared by executing the embodiments of the invention as described above and blasting the vegetation bedrock material to the normal surface or the like. In order to cultivate vegetation, a mulching method for covering around the vegetation with a vinyl film so as to prevent the soil from excessively drying or moistening is generally employed. The embodiments use a long tape having water impermeable continuous element to conduct the method. The technics and the method for blowing the tape of this case to the surface to be executed are the same as those in the previous embodiments, and the detailed description thereof will be omitted, and the different points from those of the previous embodiments will be mainly described.

In this case, in order to improve the water retention properties of the plant growing surface of the plant growing bedrock to be formed, a water impermeable tape is blown to be adhered to the surface of a plant growing surface. At this time, in order to extend the flying distance of the tape, water emulsified by dispersing aqueous solution in which a bonding agent is dissolved or a bonding agent or a muddy borrow soil base material prepared dilutely is used instead of the muddy borrow soil base material used in the previous embodiments. In the previous embodiments, the stabilization of the blasted borrow soil base material is its main object, while in this embodiment, a tape mulching method for forming a mulch layer of a tape by covering a plant growing bedrock with a tapelike film is its object, and it is accordingly necessary to widely interpose the tape without irregularity with a relatively thin layer by remotely scattering the tape with the solution or the muddy material. Thus, in this embodiment, the two- or three-folded tape is not employed, but a single tape having approx. 2 cm of width us used.

An actual example of this embodiment will be described. A blasting nozzle using the blasting nozzle 10 used in the embodiment FIG. 1 or the blasting nozzle 20 of FIG. 2 in which the hydrophobic agent pouring valve 13 was closed to blast 4000 liters of slurry, thereby intaking approx. 2500 m of tape (flat yarn) having 2 cm of width to blast it together with the solution or the muddy material and to adhere it to the surface to be executed.

In this embodiment, 4 tapes each having 2 cm of width were intaken, blown together with 4000 liters of the solution or the muddy material to the normal surface having 200 $m^2$ to be adhered thereto. In calculation, 4 tapes each having 2 cm of width were intaken and one tape is blown 2500 mm. Accordingly, it could be calculated as below.

$$2\text{ cm} \times (2500\text{ m} \times 4) = 200\text{m}^2$$

Thus, when they could be blown without irregularity to the normal surface having 200 $m^2$, a tape mulch layer having 100% of coverage was to be obtained, but since they were duplicated at some placed in fact, the coverage after the working was visually observed to be approx. 60 to 70%. Water retension effect was provided in this degree, and suitable air gaps which did not affect adverse influence to the germination and the growth of the plants could be simultaneously formed.

Then, the actual result of the test execution (trial works) of blowing the tapers will be described.

The case that aqueous solution of a bonding agent was used will be first described. The mixing contents of the aqueous solution of a bonding agent used in this test execution were as below.

| | |
|---|---|
| Adhesive (Highset 200, manufactured by Dai-ichi Kogyo Seiyaku Co., Ltd., Japan) | 2 kg |
| Erosion preventing agent (Furincoat, manufactured by Shell Petroleum Co., Ltd.) | 180 kg |
| Fresh water | 4000 liters |

The above aqueous solution was fed by pump (not shown) under pressure into the blasting nozzle (FIG. 2), and blasted to the trial work zone while tapes T were intaked from the air intale port 3. Since the hydrophobic agent was not used in this trial work, the hydrophobic agent pouring port 11 was closed by the hydrophobic agent valve 12.

Then, the trial work of the case that the muddy borrow soil base was used will be described. The mixing contents of the muddy borrow soil base material in this work were as below.

| | |
|---|---|
| Planting soil (containing organic soil) | 1250 liters |
| Vegetable fiber | 480 liters |
| Erosion preventing agent | 45 liters |
| Fresh water | 4000 liters |

The hydrophobic agent consisting of the following composition was additionally used in this work.

| | |
|---|---|
| Hydrophobic agent (polyacrylamide hydrolyzate) | 600 g. |
| Fresh water | 300 liters |

The above muddy borrow soil base material and the hydrophobic agent were blasted together with the tapes T intaked from the air intake port 3 to the surface to be executed of the trial work zone using the blasting nozzle 20 shown in FIG. 2. At this time, the hydrophobic water valve 13 was opened, and the hydrophobic agent was poured from the hydrophobic agent pouring port 11 into the agitating cylinder 2.

Figure 7:
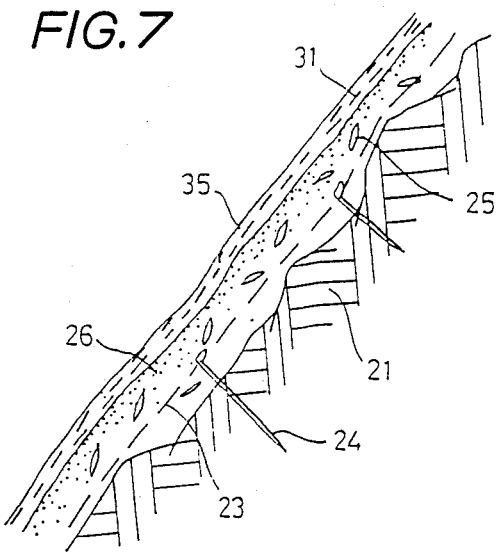
FIG. 7 is a sectional view of a tape surface to be executed with a tape mulching method on a plant growing bedrock on the normal surface of the bedrock.
Figure 8:
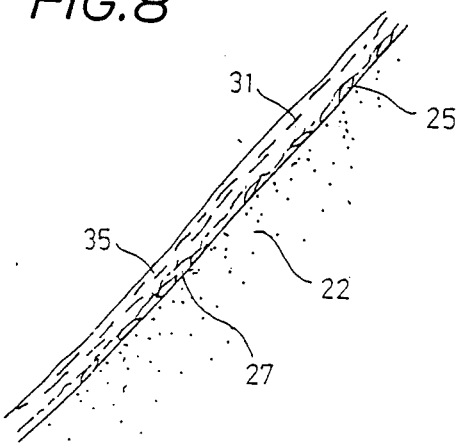
FIG. 8 is a sectional view of a tape surface to be executed with a tape mulching method on a seed blasting layer on the surface to be executed by a sand soil method.
Figure 9A:
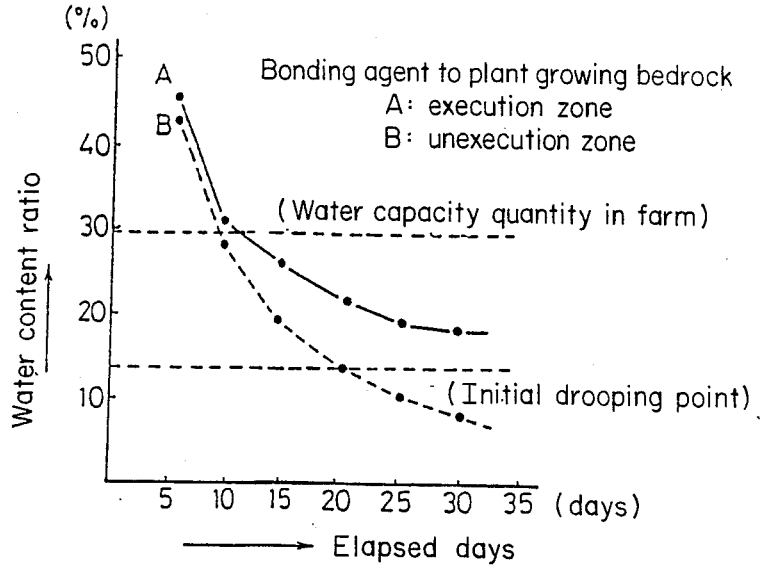
FIGS. 9 and 10 show moisture retentivity characteristic diagrams of tape mulching method execution zone with water impermeable tape on plant growing bedrock and sand soil, respectively wherein FIGS. 9(*a*) and 10(*a*) show the use of bonding agent solution, and FIGS. 9(*b*) and 10(*b*) show the use of muddy material.
Figure 9B:
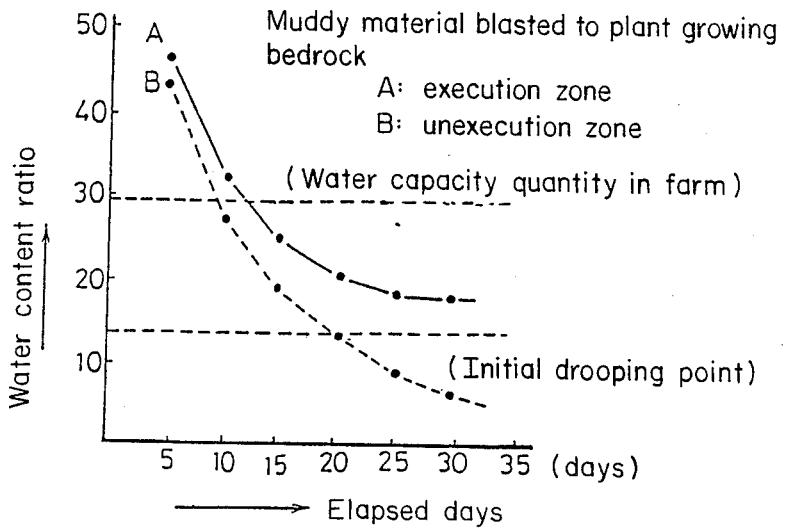
Figure 10A:
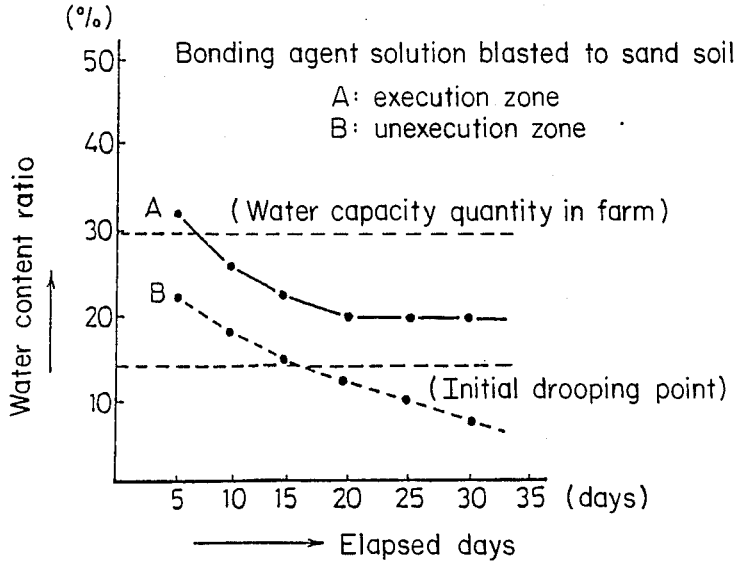
Figure 10B:
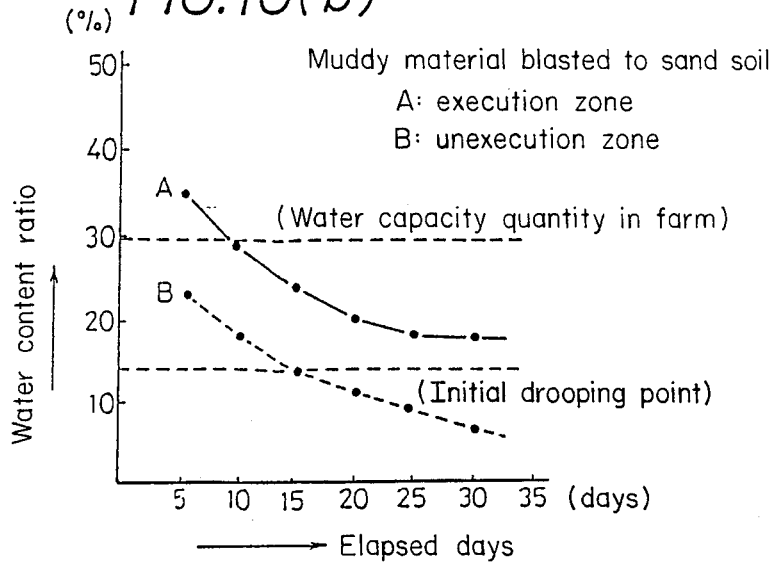

The above-mentioned two types of the materials to be executed were blasted by separate pumps and nozzles to the surface to be vegetated. As one of the surfaces to be vegetated of the trial work zone in this case, a normal surface 26 to which 10 cm of thickness of borrow soil base material was blasted as a plant growing bedrock to the normal surface 21 of the bedrock as shown in FIG. 7 was prepared, fixed to the normal surface of the bedrock by a base network 23 made of metal gauze or resin network and an anchor 24, and a vegetation material such as seeds 25 or the like was contained therein. As the other one of the surfaces to be vegetated, as shown in FIG. 8, a thin layer of a seeds blowing layer 27 including a vegetation material, such as seeds 24 was prepared on a normal surface 22 which was easily dried like sand soil. Then, the bonding agent solution or the muddy borrow soil base material were blasted together with water impermeable tapes 31 to the normal surfaces 21 and 22 to form a tape mulching layer 35. The place where was disposed adjacent to the execution zone in which no blasting was conducted at all was provided as unexecution zone of the district to be executed in the zones to be executed, 100 cc of soils were collected by soil collectors at four positions per 200 $m^2$ from a vegetation bedrock and sand soil of 2 cm from the surface in the zone to be executed of the process and the unexecution zone adjacent thereto, dried at 100° C. for 24 hours, the water content ratios (which is the ratio by weight of the water contents contained) were measured to obtain the water contents of the soils at the four positions per zone to be executed, and the average value was calculated. The results of the measurements conducted for several tens of days were shown in FIGS. 9(*a*), 9(*b*) and 10(*a*), 10(*b*). FIGS. 9 show the water content retentivity characteristic diagram of the bedrock of the case that the tapers were blown to the vegetation bedrock shown in FIG. 7, wherein FIG. 9(*a*) shows the case using a bonding agent solution, and FIG. 9(*b*) shows the case using the muddy material. FIGS. 10 show the water content of the case that the tapes were blown to the sand soil shown in FIG. 8, wherein FIG. 10(*a*) shows the case using the bonding agent solution, and FIG. 10(*b*) shows the case using the muddy material. As apparent from FIGS. 9 and 10, the zone using the aqueous solution of the bonding agent exhibited better water retension effect than the zone using the muddy borrow soil base material, but the results of both did not have large difference. Both were dried as days were passed to reduce their water content, but their water contents were held at 18 to 20%, and both were not dried to 15% of the water content of a plant growth disturbing point. On the contrary, the unexecuted zone to which the materials were not blasted were early dried, the water contents exceeded 13% of initial drooping point to be dried after 15 to 20 days were elapsed. In comparison, the effect of the tape blowing according to the invention can be evidently observed. The zones to be executed and thus measured were of normal surfaces formed relatively smoothly on the surface level. However, the tapes were positively adhered to the case using the muddy borrow base material as compared with the case using the bonding agent solution on the normal surface of largely uneven surface, and the scattering of the tapes due to wind was less.

Still another embodiments of the invention will be described. The different point of the embodiments from those described, in that the latter uses a mere water impermeable tapes as the tapes used while these embodiments use aluminum foils each having heat beam reflecting elements or aluminum foil or a water impermeable tape to which the aluminum foil is adhered, and the other conditions are the same as those in the previous embodiments. Accordingly, the other conditions will be omitted.

Figure 11:
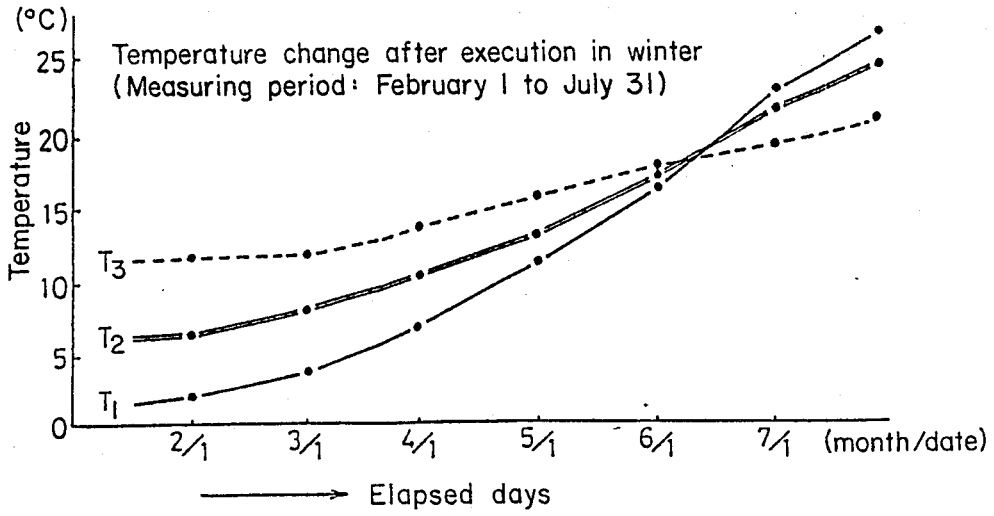
Figure 12:
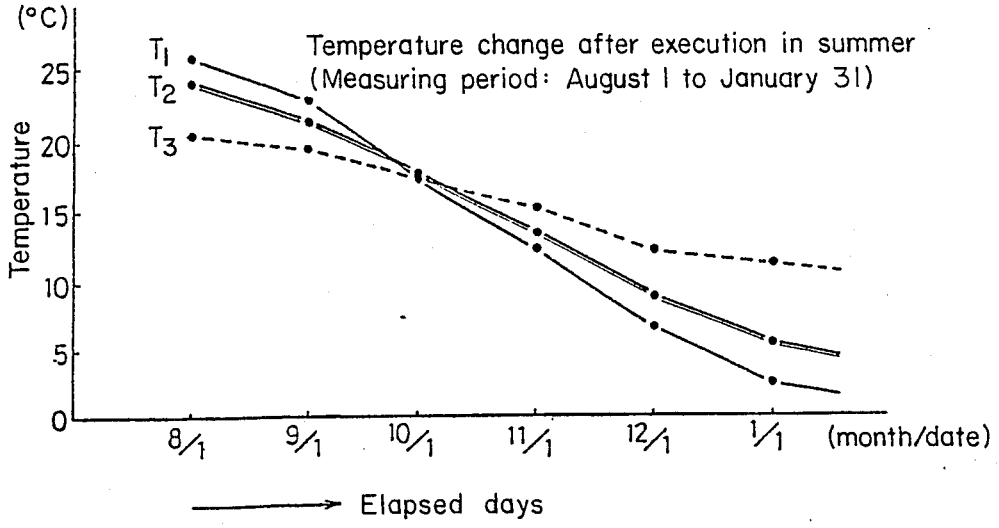

The example of these embodiments of the invention will be described. The examples were executed twice in severe cold period in winter (February 1) and in severe hot period in summer (August 1). In each case of the trial works, the water impermeable tapes each having the heat beam reflecting elements were blown using the muddy borrow soil base material. The trial zones to be executed were, similar to the previous embodiments, blasted with a plant growing bedrock to which a vegetation bedrock material was blasted in advance according to these embodiments, and the temperatures in the bedrock were measured for a period of half a year after the execution. The results are shown in FIGS. 11 and 12, in which $T_1$ are atmospheric temperatures, $T_2$ are those in unexecuted zone of the zones to be executed, and $T_3$ are temperatures in the bedrock of the zones to be executed. As shown in FIGS. 11 and 12, the variation in the underground temperatures in the execution zone thus blasted exhibited smooth corresponding to the atmospheric temperature changes as compared with that in the underground temperatures in the unexecuted zone not blasted according to these embodiments. As observed, the period of the temperature adapted for germinating and growing plants in the bedrock by the execution of these embodiments is extended as compared with that of the unexecuted zone. Therefore, the places where the process of the embodiments of the invention was executed can be extended in the period capable of executing (planting the seeds) of the large plants to improve the effect of the vegetation.

The advantages of the present invention are as below.

(1) Since the continuous elements are mixed and buried in the three-dimensional manner in the vegetation bedrock, it can prevent the vegetation bedrock material on the normal surface from sliding down to be able to increase the blasting amount per one blasting work, thereby eliminating the losses of lap blasting and drainage waiting.

(2) Since the quantity and the flying distance of the blasting vegetation bedrock material from the discharging port of the blasting nozzle are large, its working efficiency is raised, thereby executing to the long and large normal surface in a shorter period than that in the prior art.

(3) The continuous elements are contained in mixture in the vegetation bedrock to prepare environments adapted for growing the plants, such as water retentivity, drainage, air permeability, temperature maintaining property, etc. in the bedrock, thereby accelerating the vegetation.

(4) The draping effect of the continuous elements mixed in the vegetation bedrock with the vegetation bedrock is increased to stably strengthen the surface to be executed, thereby providing effects of preventing the normal surface from breaking.

(5) The surface of the vegetation bedrock is covered with the water impermeable tapelike continuous elements to raise the water retention effect in the vegetation bedrock, thereby increasing the mulching effect for germinating and growing the plants.

(6) The surface of the vegetation bedrock is covered with the water impermeable tape having heat beam reflecting elements to be adhered with aluminum foils or the like to raise the temperature maintaining effect in the vegetation bedrock, thereby extending the proper period of execution, such as the planting of seeds and the like.

What is claimed is:

1. A blasting nozzle for layering a vegetation bearing soil material onto barren ground comprising a nozzle terminating in an injection port, an agitating cylinder having a discharge port connected to said nozzle; means defining an air intake port adjacent said injection port, guide means disposed adjacent said air intake port for receiving a continuous strand element, and a valving means for valving said injection port whereby a slurry mixture of said vegetation bearing soil material is fed under pressure through said injection port to create a negative pressure thereat, and said negative pressure causing the continuous element to be intimately mixed in said agitation cylinder with the vegetation bearing soil material being forceably ejected through said injection port.

2. A blasting nozzle as defined in claim 1 and including means for introducing a hydrophobic agent adjacent said injection port and into said agitating nozzle for mixing with said vegetation bearing soil material and said continuous element.

3. A blasting nozzle for layering a vegetation bearing soil material onto barren ground to promote plant life thereon comprising a blasting nozzle, said nozzle having an injection port, an agitating cylinder having a discharge port connected to said nozzle in alignment therewith, agitating blades connected to the interior walls of said cylinder, means for introducing a slurry mixture of said vegetation bearing soil under pressure to said nozzle whereby the flow of said soil through said injection prot creates a negative pressure thereat, means defining an air intake port adjacent said injection nozzle, a continuous element threaded through said air intake port whereby the negative pressure created by the flow of soil through said injection port causes said continiuous element to be fed into said soil, and said soil and element being intimately mixed in said agitating cylinder whereby the mixture exiting said discharge prot is layered onto a barren ground.

4. A blasting nozzle as defined in claim 3 and including means disposed adjacent said injection nozzle for introducing a hydrophobic agent into said soil material discharging through said ejection port.

5. A blasting nozzle as defined in claim 4 wherein said continuous element comprises a polyethylene flat yarn.

6. A blasting nozzle as defined in claim 4, wherein said element comprises a continuous multiple folded tape.

7. A blasting nozzle as defined in claim 4, wherein said element comprises an aluminum foil tape.

8. A blasting nozzle as defined in claim 4, wherein said element comprises a fiber bundle.

9. A blasting nozzle as defined in claim 4, wherein said element comprises a bundle of irregularly folded material.

10. A process for preparing barren ground for producing vegetation thereon comprising the steps of forming a slurry mix of a planting soil, feeding said soil under pressure through an ejecting nozzle so that the flow of soil through said nozzle creates a zone of negative pressure thereat, introducing air at said zone of negative pressure; feeding a continuous strand element together with said air at said zone of negative pressure whereby said element is sucked into said zone of negative pressure to mix with said soil flowing through said ejecting nozzle, and layering said mixture of soil and strand element onto barren ground.

11. The process for preparing barren ground as defined in claim 10 and including the step of introducing a hydrophobic agent into said zone of negative pressure to mix with said soil and continuous strand element whereby said hydrophobic agent agglomerates said planting soil.

12. The process of preparing barren ground as defined in claim 11 and including the step of utilizing an impermeable tapelike strand element to mix with said planting soil.

13. The process for preparing barren ground as defined in claim 10 including the step of feeding an impermeable tapelike strand into said zone of negative pressure to mix with said planting soil.

14. The process for preparing barren ground as defined in claim 10 and including the step of feeding an aluminum tape into said zone of negative pressure to mix with said planting soil.

15. The process for preparing barren ground as defined in claim 10, wherein the step of forming said slurry mix of planting soil comprise a mix including plainting soil, fertilizer and seeds.

* * * * *